United States Patent [19]

Rohner et al.

[11] 4,232,509

[45] Nov. 11, 1980

[54] METHOD AND DEVICE FOR JOINING AN UPPER THREAD TO A LOWER THREAD

[75] Inventors: Joachim Rohner; Reinhard Mauries; Heinz Zumfeld, all of Mönchen-Gladbach, Fed. Rep. of Germany

[73] Assignee: W. Schlafhorst & Co., Mönchen-Gladbach, Fed. Rep. of Germany

[21] Appl. No.: 20,099

[22] Filed: Mar. 13, 1979

[30] Foreign Application Priority Data

| | | | |
|---|---|---|---|
| Mar. 13, 1978 | [DE] | Fed. Rep. of Germany | 2810741 |
| Apr. 13, 1978 | [DE] | Fed. Rep. of Germany | 2815999 |
| Oct. 10, 1978 | [DE] | Fed. Rep. of Germany | 2845031 |
| Nov. 27, 1978 | [DE] | Fed. Rep. of Germany | 2851252 |

[51] Int. Cl.[3] ..... D01H 15/00

[52] U.S. Cl. ..... 57/261; 57/22; 242/35.6 R

[58] Field of Search ..... 57/22, 23, 261; 242/35.5, 35.6

[56] References Cited

U.S. PATENT DOCUMENTS

| | | | |
|---|---|---|---|
| 3,311,312 | 3/1967 | Hauri | 242/35.6 R |
| 3,581,486 | 6/1971 | Dibble | 57/22 |
| 3,822,538 | 7/1974 | Cardell | 57/22 |
| 3,918,651 | 11/1975 | Uehida | 242/35.6 R |
| 4,002,012 | 1/1977 | Norris | 57/22 |

FOREIGN PATENT DOCUMENTS

| | | | |
|---|---|---|---|
| 956992 | 4/1964 | United Kingdom | 57/22 |

*Primary Examiner*—Donald Watkins
*Attorney, Agent, or Firm*—Herbert L. Lerner

[57] ABSTRACT

Method and device for joining together an upper and a lower thread, which includes moving at least one first thread feeder from a thread pick-up position to a thread transfer position, inserting the upper and the lower threads into a longitudinal slot formed in a chamber, holding the threads in the slot until compressed air is admitted to the chamber, and at given positions during the movement of the first thread feeder; closing the chamber with a lid, automatically severing the ends of the upper and lower thread and blowing compressed air into the chamber.

18 Claims, 3 Drawing Figures

METHOD AND DEVICE FOR JOINING AN UPPER THREAD TO A LOWER THREAD

The invention relates to a method and apparatus for joining an upper thread to a lower thread by means of a device having a chamber with a longitudinal slot formed therein for inserting and joining the threads. The slot formed in the chamber is capable of being covered up. In the slot, the threads are spliced by means of compressed air coming from the side and are joined together in this manner.

Up to now, the threads have been placed in such a device by hand. The quality of the thread joint as well as the time for effecting the joint depended on chance. It is accordingly an object of the invention to provide a method and device for joining an upper thread to a lower thread which overcomes the hereinafore-mentioned shortcomings of the above-described devices of the general type and to eliminate all influences in the making of a splice that reduce the quality thereof and depend on manual dexterity.

With the foregoing and other objects in view, there is provided, in accordance with the invention a method and device for joining together an upper and a lower thread, which indludes moving at least one first thread feeder from a thread pick-up position to a thread transfer position, inserting the upper and the lower threads into a longitudinal slot formed in a chamber, holding the threads in the slot until compressed air is admitted to the chamber, and at given positions during the movement of the first thread feeder: closing the chamber with a lid, automatically severing the ends of the upper and lower thread and blowing compressed air into the chamber.

In accordance with another mode of the invention, there is provided a method which includes inserting the threads into the longitudinal slot in an uncrossed and parallel condition.

In accordance with a further mode of the invention, there is provided a method which includes crossing the threads during the rotary motion of the first thread feeder.

In accordance with an additional mode of the invention, there is provided a method which includes finding and holding the end of the upper thread and the end of the lower thread with separate second and third thread feeders, and subsequently aligning the threads by a counterrotating movement of the second and third thread feeders.

In accordance with an added mode of the invention, there is provided a method which includes orienting the threads in a crossed, parallel or overlapping condition by the alignment step.

Further in accordance with the invention, there is provided an apparatus for carrying out a method for joining together an upper and a lower thread, comprising a chamber having a closable, longitudinal, thread-receiving and joining slot formed therein, a compressed-air canal opening into the interior of the chamber, at least one first thread feeder movable from a thread pickup position to a thread transfer position for placing the threads into the longitudinal slot formed in the chamber, and further comprising a lid for temporarily closing off the chamber, thread severing devices for cutting off the ends of the upper and the lower thread, and an adjustable and controllable compressed-air dosing valve disposed in the compressed-air canal, each of which being activatable at a given position of the first thread feeder.

In accordance with another feature of the invention, the first thread feeder is rotatably supported and includes two thread guiding arms, one of which is movable in a place of rotation above the chamber and the other of which is rotatable in a plane of rotation below the chamber.

In accordance with a further feature of the invention, there is provided a rotatably supported second thread feeder having means for finding and holding the upper thread, and a rotatably supported third thread feeder having means for finding and holding the end of the lower thread, a thread take-up coil and upper and lower thread clamping devices disposed above and below the chamber, respectively, the second thread feeder being activatable for picking up and passing on the upper thread from the take-up coil to below the lower thread clamping device, and the third thread feeder being activatable for passing on the lower thread from a point in the path of the lower thread to above the upper thread clamping device.

In accordance with an additional feature of the invention, there are provided means for controlling the thread clamping devices relative to the position of the first thread feeders and/or all three thread feeders.

In accordance with an added feature of the invention, there are provided aperture edges extending away from the chamber in a given direction on opposite sides of the longitudinal slot, the thread guiding arms each having at least one thread receiving slot formed therein the receiving slots being disposed, in thread transfer position of the first thread feeder, at an angle with respect to the aperture edges and behind the aperture edges opposite to the given direction so as to loop the threads around the aperture edges upon movement of the guiding arms.

In accordance with yet another feature of the invention, one of the thread severing devices is controllably mounted on each guiding arm.

In accordance with yet an additional feature of the invention, there are provided means for adjustably operating the dosing valve at blasting intervals.

In accordance with yet an added feature of the invention, there are provided means for adjustably controlling air pressure supplied to the dosing valve, and proximity switch means for controlling the dosing valve and/or the air pressure controlling means, adjustably responsive to the movement of the first thread feeder.

In accordance with still another feature of the invention, there is provided an adjustable timer operatively connected to the dosing valve and/or the air pressure controlling means.

In accordance with still a further feature of the invention, there are provided central setting means connected to the dosing valve and/or the air pressure controlling means for controlling the supply of air pressure to and/or the timers at, a plurality of work stations.

In accordance with a concomitant feature of the invention, there is provided a compressed-air reservoir disposed upstream of the dosing valve.

This apparatus is capable of bringing about automatic operation from picking up the individual threads to the finished thread joint.

The advantages obtained with the invention are in particular that at least from the transfer of the individual threads on, all chance and uncertainties resulting from manual handling are eliminated. In addition, the invention teaches how to automatize the entire operating cycle of joining the threads in an advantageous manner, starting from finding the threads at the device furnishing the lower thread and the device which picks up or passes on the upper thread.

The invention also makes it possible for the joined-together threads to be pulled out of the chamber without special auxiliary means, after the chamber is opened. This is done by the resumed winding tension and the transversal force exerted thereby on the thread strand. The threads are then removed from the device for joining the threads together.

All operations are tuned to each other. The time and duration of each important operation is adjustable; this applies especially to the time and duration of the air injection and to the time of severing the excess thread ends.

The apparatus for joining the upper thread to the lower thread can be a device which travels from work station to work station.

If a thread feeder works with suction air or negative pressure, a controlled clamping lid can advantageously be fastened to the suction nozzle and release the suction nozzle only as long as the thread end is being searched for and picked up. The later holding of the thread end is then taken over by the clamping lid which simultaneously closes off the suction nozzle.

A single, preferably two-armed, pivoted thread feeder may in some circumstances be sufficient for inserting the threads to be joined in the longitudinal slot of the chamber. If the threads must first be found in the transfer or pickup zone, at least two pivoted thread feeders are necessary. It has been found to be particularly advantageous to provide, in the last-mentioned case, a third thread feeder which takes over the control of the threads from the first two thread feeders and transports them into the chamber in a sideways-swinging motion, the threads being crossed at the same time.

Other features which are considered as characteristic for the invention are set forth in the appended claims.

Although the invention is illustrated and described herein as embodied in a method and device for joining an upper thread to a lower thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
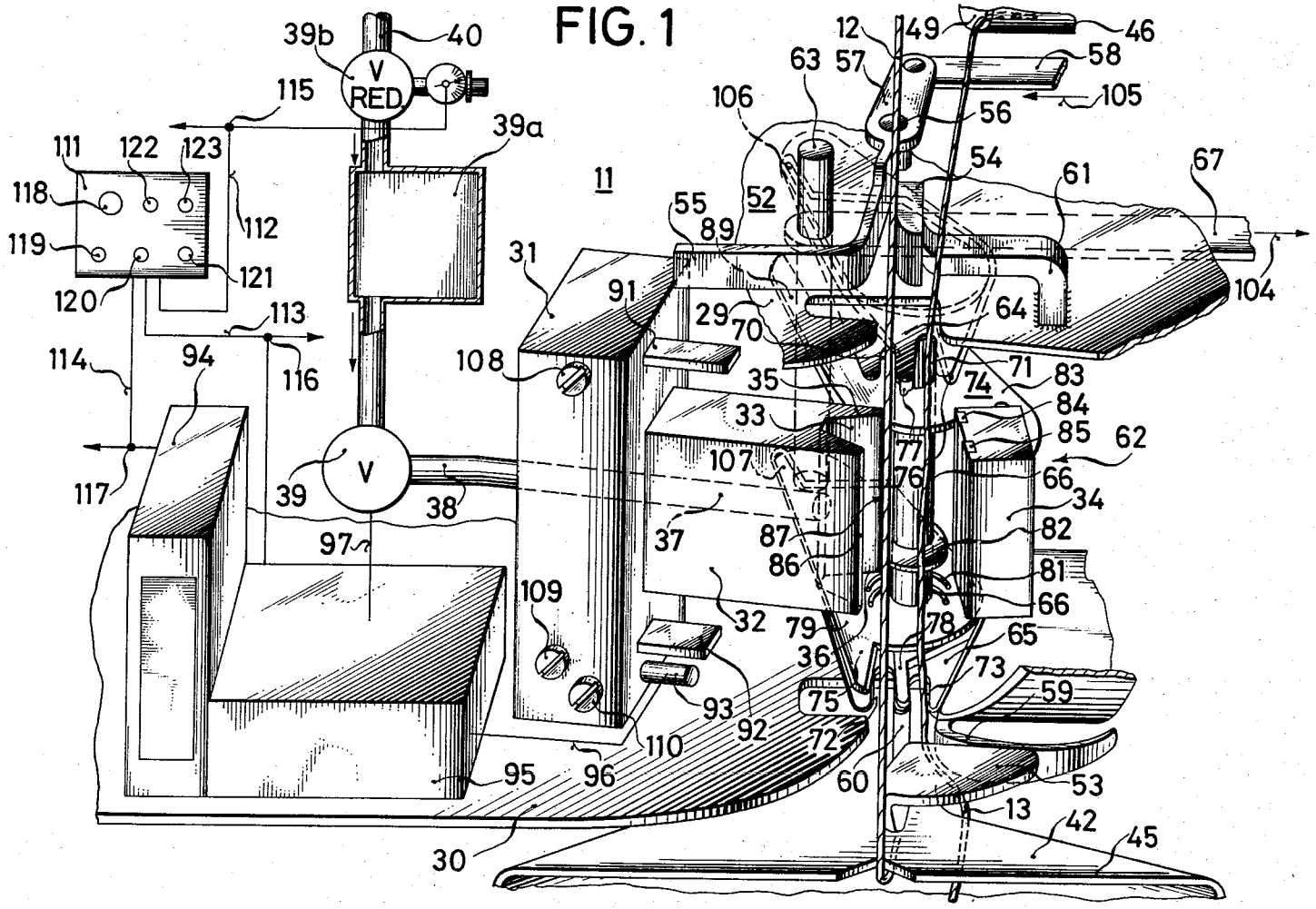
FIG. 1 is a diagrammatic perspective view of the apparatus according to the invention with the chamber open.
Figure 2:
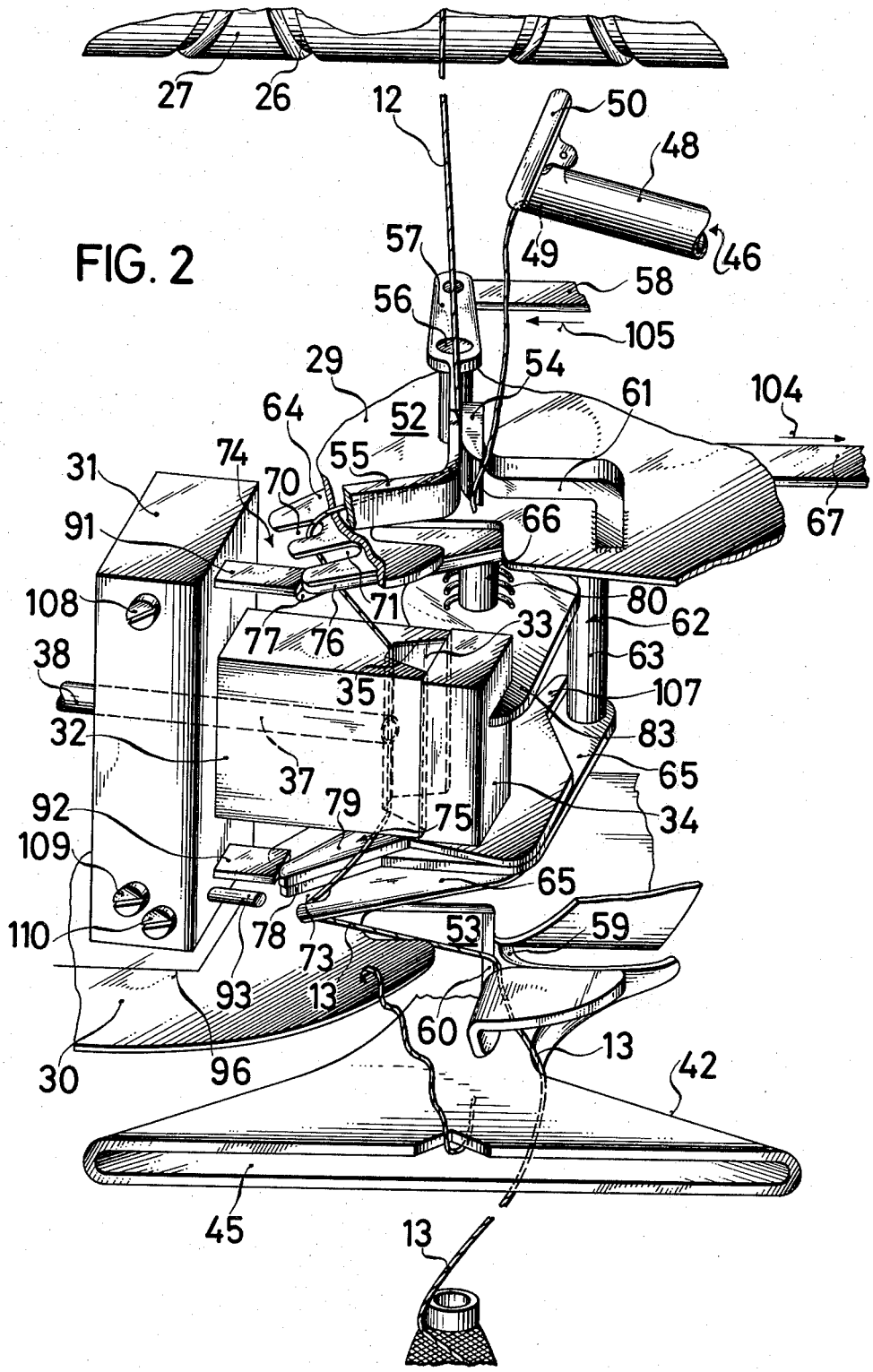
FIG. 2 is a diagrammatic perspective view partly broken away with the chamber closed.
Figure 3:
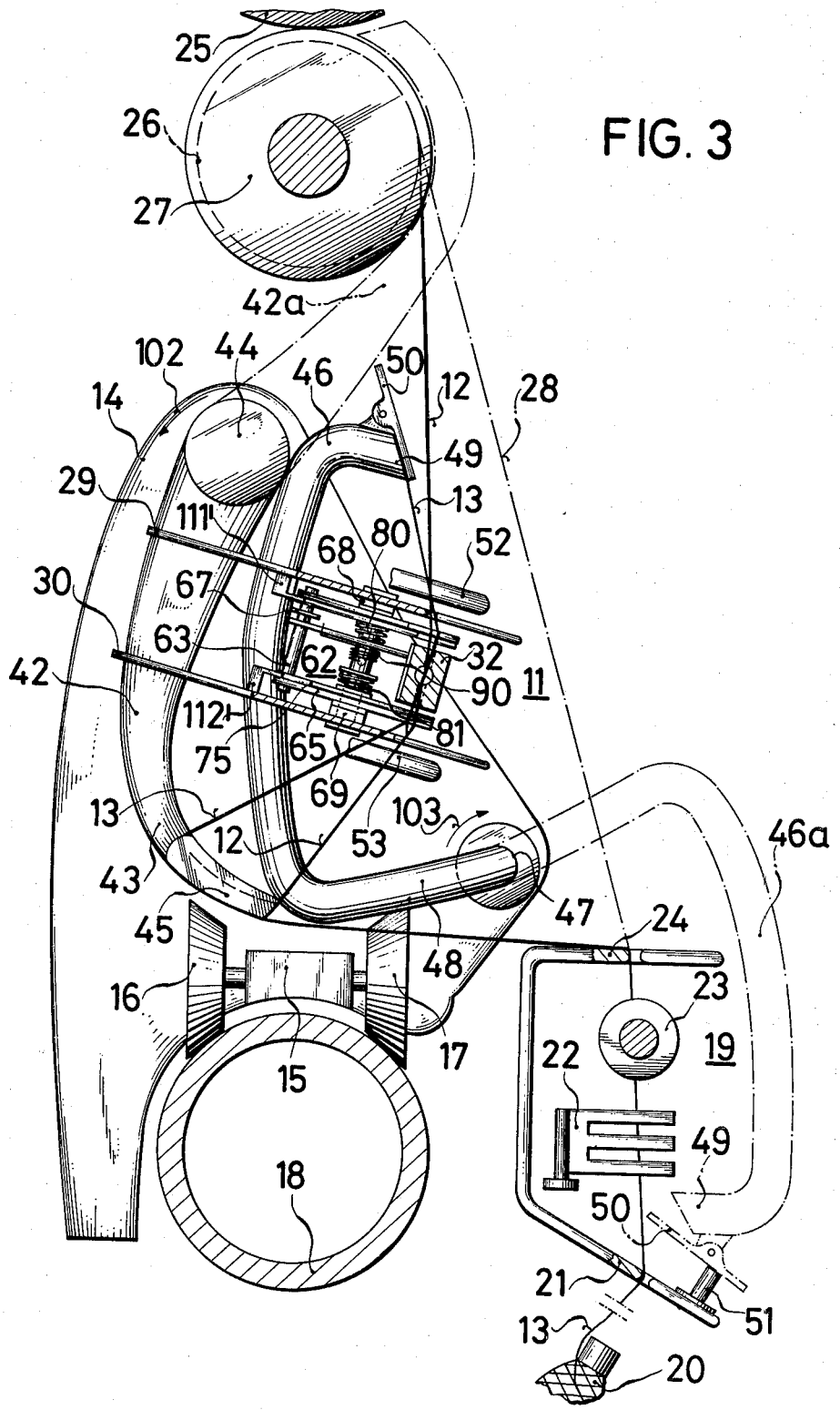
FIG. 3 is a side view of the apparatus.

Referring now to FIGS. 1, 2 and 3 of the drawing, there is seen a device, designated as a whole with reference numeral 11, for joining an upper thread 12 to a lower thread 13. The apparatus 11 has a machine frame 14, which supports a carriage 15 as shown in FIG. 3. The carriage 15 has rollers 16 and 17, by means of which the apparatus 11 can be moved on a support tube 18.

The support tube 18 is disposed alongside a winding machine. In FIG. 3 only one winding station 19 of the winding machine is visible. The apparatus 11 is operative at this winding station 19 at the time shown in FIG. 3. At the winding station 19, the lower thread 13 travels to the device 11 from an unwinding coil 20 by way of a thread guide 21, a rake feeler 22, a thread brake 23 and a further thread guide 24. The upper thread 12 travels from a take-up coil 25, past a thread guide cylinder 27 provided with reversing thread grooves 26, and finally to the apparatus 11.

In a narrower sence, the device furnishing the lower thread 13 includes mainly the thread guide 21, and the device accepting the upper thread includes mainly the take-up spool 25. The line of the shortest possible, uninfluenced and undisturbed thread path is the dot-dash line designated with reference numeral 28.

The line 28 is shown as a dot-dash line to indicate that the run of the thread is already disturbed and the thread itself is separated into an upper thread and a lower thread.

The device 11 has two sideplates 29, 30 which are fastened to the machine frame 14 and are connected to each other by a support 31, clearly shown in FIGS. 1 and 2. To the latter is fastened a chamber 32. The chamber 32 has a longitudinal slot 33 which can be closed by a lid 34. If the lid is opened, the threads can be placed in the longitudinal slot of the chamber. The aperture edges 35, 36 (FIG. 1) of the longitudinal slot 33 are rounded off. A compressed-air canal 37 opens into the interior of the chamber 32 which is closed by the longitudinal slot 33 and the lid 34. The compressed-air canal 37 is continued in a tube 38. A compressed-air reservoir 39*a* (FIG. 1) is disposed on the compressed-air inlet side of a compressed-air dosing valve 39. Upstream from the compressed air reservoir 39*a* there are means for adjustably controlling air pressure supplied to the dosing valve or an adjustable pressure reducer 39*b*. The compressed-air dosing valve 39 can be connected to a source of compressed air through a pipe 40.

A thread feeder 42 is provided with means for finding and holding the thread end of the upper thread 12 on the take-up coil 25. These means include a hollow arm 43 (FIG. 3), which is connected by a rotary joint 44 to a conventional underpressure source not shown in detail, and a suction slit nozzle 45. FIG. 3 shows the thread feeder 42 in the thread transfer position. Its thread pickup position is designated with reference numeral 42*a* and is shown by dot-dash lines in FIG. 3.

Another pivoted thread feeder 46 is provided with means for finding and holding the thread end of the lower thread 13. These means include a curved tube 48 rotatable at a rotary joint 47, with a suction nozzle 49 which is closed by a clamping lid 50 by means of the force of a spring. Similarly to the thread feeder 42, the other thread feeder 46 is shown in FIG. 3 in the thread transfer position. Its thread pick-up position is designated with reference numeral 46*a* and shown in dot-dash lines in FIG. 3. To pick up the thread end of the lower thread 13, the clamping lid 50 is opened by striking a stop 51. Then, the lower thread, which may be broken, for instance, above the thread brake 23, can be sucked up by the suction nozzle 49 and clamped, held and taken along between the clamping lid 50 and the edge of the suction nozzle 49 when the thread feeder 46 is swung up into the thread transfer position.

The drawings also show two controllable thread clamping devices 52, 53. The thread clamping device 52 is disposed above the chamber 32 and also above the side plate 29, and the thread clamping device 53 is disposed below the chamber 32 and also below the side plate 30. Each of the two thread clamping devices is constructed of two parts, best seen in FIGS. 1 and 2. The thread clamping device 52 has a stationary clamp member 54 and a controllable clamp 55 which can be rotated about a rotary joint 56 and has a lever 57 which can be controlled by a cam, not shown, that is further controlled by means of a rod 58. The thread clamping device 53 has a stationary clamp member 59 and a controllable clamp 60 which, like the clamping device 52, can be controlled by a conventional cam which is not shown. The clamp member 54 is connected to the side plate 29 by a bracket 61. The clamp member 59 is connected to the side plate 30.

In the drawings there can further be seen a pivoted two-armed thread feeder 62, including a pin 63 with arms 64, 65 fastened thereto. The two-armed thread feeder 62 is rotatably supported on a shaft 66 which connects the side plate 29 to the side plate 30. For rotating the thread feeder 62 about the shaft 66, a rod 67 is flexibly connected to the pin 63.

Spacers 68, 69 serve for centering the thread feeder 62. The thread feeder 62 can be swung from the thread pickup position shown in FIG. 1 into the thread transfer position shown in FIG. 2. The plane of rotation of the arm 64 is above and the plane of rotation of the arm 65 is below the chamber 32. In the thread pick-up position, the two arms of the thread feeder 62 lie in the path of the threads 12, 13 which are parallel after the thread feeders 42 and 46 are swung into their thread transfer positions.

Each arm of the thread feeder 62 has two adjacent thread receiving slots of unequal depth or length. FIG. 1 and FIG. 2 show that the thread receiving slot 71 of the arm 64 is deeper than the thread receiving slot 70. Similarly, the thread receiving slot 72 of the arm 65 is deeper than the thread receiving slot 73. These thread receiving slots of unequal depth are formed so that the shallower thread receiving slot of the one arm is always lined up over the deeper thread receiving slot of the other arm. In the thread pickup position of the thread feeder 62, the thread receiving slots lie approximately in the plane of rotation of the thread feeders 42 and 46.

Each arm of the thread feeder 62 has a controller thread-severing device; the thread severing device 74 being associated with the arm 64 and the thread severing device 75 with the arm 65. Each thread severing device includes two blades acting like scissors. One blade is always connected to the corresponding arm, and the other blade, that is to say the blade located closest to the chamber 32 is pivoted about the shaft 66. The blade 76 of the thread severing device 74 is connected, for instance, to the arm 64, while the blade 77 of the same thread severing device is pivoted. The blade 78 of the thread severing device 75 is connected to the arm 65, while the blade 79 of the same thread severing device is pivoted. FIG. 2, in particular, shows that the blade 77 is pressed against the blade 76 by a coil spring 80. FIG. 1 shows that the blade 79 is also pressed against the blade 78 by a coil spring 81. The coil spring 81 is braced against a washer 82 fastened on the shaft 66. The coil spring 80 is braced against a swing arm 83 which is rotatably supported on the shaft 66 and carries the lid 34 of the chamber 32. The lid 34 has inserts 84, 85, of sealing material, which come to lie against the edges 86, 87 of the longitudinal slot 33 when the lid is closed and thereby prevent compressed air and individual fibers from laterally escaping from the chamber 32. The thread feeder 62, the thread severing devices 74, 75 and the swing arm 83 of the lid 34 not only have a common pivot axis 66 but they can also be swung together. To this end, the pivoted arm 83 has at its rear end a lever 89 which rests against the pin 63 under the action of a wound coil spring 90 as shown in FIG. 3. While the two blades 76 and 78 are connected to the arms 64 and 65, respectively, the pivoted blades 77 and 79 are also taken along under the action of the coil springs 80, 81 when the thread feeder 62 is rotated. This taking-along with the blades 76 and 78 is limited by adjustable stops 91, 92. Adjustability of the stops is provided by setscrews 108, 109. The time of severing the thread ends can thereby be adjusted accurately and matched to the time when the compressed air is admitted, or to the blasting time. If the thread feeder 62 is now swung into the position shown in FIG. 2, the thread severing devices 74 and 75 close, the lever 106 (FIG. 1) of the blade 77 and likewise a similar lever 107 of the blade 79 being lifted off the pin 63. The thread severing devices are now closed in scissor-fashion. If the thread feeder 62 is swung back into the thread pickup position, the pin 63 comes to lie against the levers 106 and 107, whereby the thread severing devices are opened again in scissor-fashion when the rotation continues. The thread severing devices 74 and 75 are disposed so that they always become operative at those thread receiving slots in which the thread ends to be severed lie; i.e., in the case of the arm 64, the thread receiving slot 71 and in the case of the arm 65, the thread receiving slot 72. It is seen in FIG. 2 that the thread receiving slots of the thread feeder 62 are, in the thread transfer position shown, at an angle above and below the aperture edges 35, 36, respectively, of the chamber 32, the threads being looped around the edges of the aperture.

The dosing valve 39 can be controlled by means of a proximity switch 93 which responds to the motion of the thread feeder 62 and can be adjusted by means of a setscrew 110. The switch 93 can be set and controlled by means of a timer 94. For this purpose, the parts 39, 93 and 94 are connected to a switch box 95 which contains conventional electrical switching device. The adjustibility of the proximity switch 93 ensures accurate setting of the start of the air injection as a function of the position of the thread feeder 62 and therefore also as a function of the position of the thread severing devices and the time of severing the thread ends. In FIG. 1, the line 96 leading to the proximity switch 93 and the line 97 leading to the compressed-air dosing valve 39 can be seen.

The compressed-air dosing valve 39 can be adjusted for the duration of the intervals and their spacing in time. In addition, the compressed-air dosing valve 39 is connected to the pressure reducer **39*b* which serves for setting and controlling the air pressure. Air pressure setting is accomplished by a central adjusting device 111, to which the pressure reducer 39*b*, the switch box 95 and the timer 94 are connected by lines 112, 113 and 114, respectively. From the branching points 115, 116 and 117 of these lines, branches go to the pressure reducers, switch boxes and timers of the other work stations of the textile machine which the herein discussed apparatus 11 also services. The central setting of the air pressure is accomplished by the control knob 118, the setting of three different blasting intervals by the control knobs 119, 120, 121 and the setting of the spacings in time of the intervals by the control knobs 122 and 123**. The timer switching box, proximity switch and control knobs may all be devices which are well known to a man of ordinary skill in the textile art, any variety of which can be easily used in the invention of the instant application.

FIGS. 1 and 2 show that some parts of the device 11 have special thread-guiding contours. This is the case, for instance, for the suction slit nozzle 45, the thread clamping devices 52, 53 and the side plates 29 and 30.

The operation of the apparatus according to the invention will now be explained by example of the thread-joining operation, referring to the drawings. The hereinafore mentioned settings have already been made at the setting device 111.

It will first be assumed that at the winding station 19 the thread which previously followed the line 28, was broken. This produced an upper thread 12 and a lower thread 13. The upper thread 12 was taken up by the take-up coil 25 and the lower thread 13 was held by the thread brake 23 in conjunction with the rake feeler 22.

The thread break was detected in a known manner and the existence thereof was communicated to the device 11. At the time shown in FIG. 3, the device 11 has been moved on the support tube 18 in front of the winding station 19. The thread feeders 42 and 46 are in the rest position which is identical with the thread transfer position if one ignores the threads already shown in FIG. 3. The third thread feeder 62 is in the thread pick-up position shown in FIG. 1. The threads shown are, initially, to be regarded as nonexistent. The apparatus 11 now becomes active in the following manner:

In the machine frame 14 is located a conventional control drive, not specifically shown, which starts up automatically upon a signal initiated by the winding station 19, and rotates the rotary joint 44 of the thread feeder 42 in the direction of the arrow 102 until the thread feeder has reached the thread pickup position 42*a*. In this position, the suction slit nozzle 45 is situated close to and in front of the surface of the take-up coil 25. The suction slit nozzle 45 extends over the entire width of the take-up coil 25. With the take-up coil 25 rotating slowly or running down, the thread end of the upper thread 12 is found, sucked up and held fast by the underpressure acting at the suction nozzle 45. Simultaneously, the control drive rotates the rotary joint 47 of the thread feeder 46 in the direction of the arrow 103 until the thread feeder 46 has reached the thread pick-up position 46*a*. There, the clamping lid 50 runs against the stop 51 and is opened thereby. Now, the underpressure effective in the suction nozzle 49 can suck up the thread end of the lower thread 13 and hold it fast.

After a brief, preset action time, the control drive returns the two rotary joints 44 and 47 into their starting positions. In this process, the two thread feeders 42 and 46 simultaneously swing into the thread transfer positions shown by solid lines in FIG. 3. While the thread feeder 46 is being rotated, the clamping lid 50 closes again and thus holds the thread end clamped.

When the thread feeders 42 and 46 are swung back, the threads slide into the thread receiving slots of the thread feeder 62. The abovementioned thread guiding contours ensure that the upper thread 12, coming from the take-up coil 25, is inserted between the clamping member 54 and the clamp 55 of the thread clamping device 52 and into the thread receiving slots 70 and 72 of the thread feeder 62. Coming from the unwinding coil 20 past the thread guide 21, the lower thread 13 is inserted into the rake feeler 22, the thread brake 23 and the thread guide 24. The thread 13 is led over the rear side of the suction slit nozzle 45 of the thread feeder 42, conducted between the clamping member 59 and the clamp 60 of the thread clamping device 53 and is inserted into the thread receiving slots 73 and 71 of the thread feeder 62. Since both thread feeders 42 and 46 are swung back simultaneously, the rounded rear side of the suction slit nozzle 45 takes the lower thread 13 along and deflects it, as shown in FIG. 3. During the rotary motion of the thread feeders 42 and 46, the thread clamping devices 52 and 53 are open.

The control drive now sets in motion two cams, not shown, which ensure that the rod 67 is pulled in the direction of the arrow 104 and that the rod 58 is pulled in the direction of the arrow 105. During the motion of the rod 67, the two arms of the thread feeder 62 and the swing arm 83 of the lid 34 swing to the left. Because of the unequal depth of the thread receiving slots, the threads are inserted into the longitudinal slot 33 in a crossed condition. The two thread severing devices still remain open. Shortly before the end position shown in FIG. 2 is reached, which is equivalent, as far as the thread feeder 62 is concerned, with the thread transfer position, the lid 34 with its inserts 84, 85 comes to lie against the edges 86 and 87 of the longitudinal slot 33 of the chamber 32. Simultaneously, the two thread clamping devices 52, 53 are closed, while the blades 77 and 79 hit the stops 91 and 92, respectively. At the same instant, the proximity switch 93 detects the approach of the arm 65 of the thread feeder 62. The proximity switch 93, by way of the electric switching device located in the switching box 95, switches on the compressed-air dosing valve 39 with the intervals set at the central setting device 111, by which the timer 94 then controls the blasting time. The compressed-air supply in the compressed-air reservoir 39*a* now flows into the chamber 32. Simultaneously, a replenishment of compressed air of given pressure enters through the likewise centrally adjusted pressure reducer 39*b*. During the blasting intervals, the two arms of the thread feeder 62 continue to swing to the left, so that they finally reach the end position. In the meantime, the thread severing devices are activated and the excess thread ends are cut off and sucked off, or held fast by the clamping lid 50. A soft adjustment of the thread clamping devices ensures bringing up the threads if the splicing operation requires this.

From the end position shown in FIG. 2, the thread feeder 62 is brought back into its base position without delay and the thread clamping devices are opened inasmuch as the cams ensure that the rod 67 is moved back against the direction of the arrow 104 and the rod 58 against the direction of the arrow 105. At the beginning of this return motion, the thread severing devices at first remain closed for a limited time, namely, until the pin 63 has reached the two levers 106 and 107, after which the thread severing devices can be opened again. Also, the lid 34 is opened after a time delay, and specifically, only after the pin 63 has reached the lever 89 of the swing arm 83. Depending on the force of the springs 80, 81 and 90, the resetting of the thread severing devices and the complete opening of the lid 34 are effected only if the pin 63 has been returned by the rod 67 as far as shown in FIG. 1. The backs of the levers 106, 107 have then come to rest against the stops 111', 112' shown in FIG. 3.

The thread joined together by means of compressed air now lies in the opened thread clamping device 53, in the thread receiving slot 73 of the arm 65, in front of the opened chamber 32, in the thread receiving slot 70 of the arm 64 and in the opened thread clamping device 52.

If the winding station 19 now subsequently resumes operation, the thread snaps out of the device 11 due to the resumed winding tension and assumes a thread path according to the line 28 in FIG. 3. The activity of the device 11 is now at an end and it can travel to another point of deployment. The thread is again outside of the travel zone of the device 11.

The device 11 can be constructed to be stationary or to be capable of traveling. It can be provided as desired at each winding station or work station of a textile machine or be active sequentially at different work stations. Alternatively, the pressure reducer can be given a different setting from interval to interval, which can likewise be done by the control knob 118.

The invention is not limited to the embodiment example shown and described. With a small construction change, for instance, the thread feeder 62 can be eliminated. To this end, the chamber 32 would have to be rotated so that the longitudinal slot 33 faces front, since then, the thread feeders 42 and 46 could place the thread in the longitudinal slot 33. The rod 67 then would still be required only for opening and closing the lid 34 and for operating the thread severing devices. However, this simplified embodiment of the invention may bring with it difficulties in crossing the threads to be inserted, so that the placement of a third thread feeder 62 in conjunction with thread severing devices seems to be more advantageous.

The terms upper thread and lower thread do not necessarily refer to the terms "top" and "bottom". The lower thread is more precisely designated a thread which comes from a thread supply point, for instance, an unwinding coil or from a thread generator. The upper thread is the thread leading to a thread take-up point, for instance, a take-up coil of a winding beam. The travel direction of the thread can be from the bottom up as is the case in the embodiment example. However, the thread can also run in the opposite direction or have any position in space, such as horizontal for instance.

Besides winding machines, the apparatus according to the invention can also be used, for instance, in spinning frames, creels and similar machines of any kind.

So that threads with an unusual fiber structure and thick threads can also be joined together reliably, it is advantageous to place the threads in the chamber in an uncrossed condition and preferably parallel, and to hold them in this position up to the instant that the compressed air is admitted. This does not otherwise preclude crossing the threads during the rotary motion of the thread feeders; it is only necessary to see to it that in every case the crossing takes place outside the chamber in which the splicing by compressed air is performed.

The fact that joining thick threads and threads with a special fiber structure is more successful if the threads are parallel is explained by the circumstance that the pneumatic flow conditions at the thread are more favorable and a crossing of the threads within the chamber cannot always be reliably fixed at a pneumatically advantageous place.

Uncrossed placement of the threads in the chamber is achieved providing the two arms of the thread feeder 62 with thread receiving slots of equal depth rather than of unequal depth.

The statements made so far point out the further advantages of the invention:

Under unfavorable conditions, air pressure with little variation and of sufficient strength is also available in the chamber at the opening of the compressed-air canal, after the compressed-air dosing valve is opened.

The undesirable pressure drop due to air flowing through long lines is avoided. At the same time, it is possible to use a compressed-air source of varying pressure to advantage or to tap it from operation to operation. Finally, the compressed-air reservoir or reservoirs can be made large enough so that their supply is sufficient for a number of splicing operations if the compressed-air source fails.

If production is changed over, it is not necessary to change the adjustment of the splicing device in every case. Should this nevertheless be necessary, such a change of setting can be done centrally.

There are claimed:

1. Method for joining together an upper and a lower thread, which comprises moving at least one first thread feeder from a thread pick-up position to a thread transfer position, inserting the upper and the lower threads into a longitudinal slot formed in a chamber, holding the threads in the slot until compressed air is admitted to the chamber, and at given positions during the movement of the first thread feeder: closing the chamber with a lid, automatically severing the ends of the upper and lower thread and blowing compressed air into the chamber.

2. Method according to claim 1, which comprises inserting the threads into the longitudinal slot in an uncrossed and parallel condition.

3. Method according to claim 1, which comprises crossing the threads during the rotary motion of the first thread feeder.

4. Method according to claim 2 or 3, which comprises finding and holding the end of the upper thread and the end of the lower thread with separate second and third thread feeders, and subsequently aligning the threads by a counterrotating movement of the second and third thread feeders.

5. Method according to claim 4, which comprises orienting the threads in a parallel condition by the alignment step.

6. Method according to claim 4, which comprises orienting the threads in a crossed condition by the alignment step.

7. Method according to claim 4, which comprises orienting the threads in an overlapping condition by the alignment step.

8. Apparatus for carrying out a method for joining together an upper and a lower thread, comprising a chamber having a closable, longitudinal, thread-receiving and joining slot formed therein, a compressed-air canal opening into the interior of the chamber, at least one first thread feeder movable from a thread pickup position to a thread transfer position for placing the threads into the longitudinal slot formed in the chamber, and further comprising a lid for temporarily closing off the chamber, thread severing devices for cutting off the ends of the upper and the lower thread, and an adjustable and controllable compressed-air dosing valve disposed in said compressed-air canal, each of which being activatable at a given position of said first thread feeder.

9. Apparatus according to claim 8, wherein said first thread feeder is rotatably supported and includes two thread guiding arms, one of which is movable in a plane or rotation above the chamber and the other of which is rotatable in a plane of rotation below the chamber.

10. Apparatus according to claim 8 or 9, including a rotatably supported second thread feeder having means for finding and holding the upper thread, and a rotatably supported third thread feeder having means for finding and holding the end of the lower thread, a thread take-up coil and upper and lower thread clamping devices disposed above and below the chamber, respectively, said second thread feeder being activatable for picking up and passing on the upper thread from the take-up coil to below said lower thread clamping device, and said third thread feeder being activatable for passing on the lower thread from a point in the path of the lower thread to above said upper clamping device.

11. Apparatus according to claim 10, including means for controlling said thread clamping devices relative to the position of at least said first of said three thread feeders.

12. Apparatus according to claim 11, including aperture edges extending away from the chamber in a given direction on opposite sides of the longitudinal slot, said thread guiding arms each having at least one thread receiving slot formed therein, said receiving slots being disposed, in thread transfer position of said first thread feeder, at an angle with respect to said aperture edges and behind said aperture edges opposite to said given direction, so as to loop the threads around the aperture edges upon movement of said guiding arms.

13. Apparatus according to claim 12, wherein one of said thread severing devices is controllably mounted on each guiding arm.

14. Apparatus according to claim 8, including means for adjustably operating said dosing valve at blasting intervals.

15. Apparatus according to claim 14, including means for adjustably controlling air pressure supplied to said dosing valve, and proximity switch means for controlling at least one of said dosing valve and said air pressure controlling means adjustably responsive to the movement of said first thread feeder.

16. Apparatus according to claim 15, including an adjustable timer operatively connected to at least one of said dosing valve and said air pressure controlling means.

17. Apparatus according to claim 16, including central setting means connected to at least one of said dosing valve and said air pressure controlling means for controlling at least one of the supply of air pressure to and said timers at a plurality of work stations.

18. Apparatus according to claim 14, 15, 16 or 17, including a compressed-air reservoir disposed upstream of said dosing valve.

* * * * *